US010968658B2

(12) United States Patent
Furuland

(10) Patent No.: US 10,968,658 B2
(45) Date of Patent: Apr. 6, 2021

(54) FOLDABLE CANOPY AND METHOD OF USING SAME

(71) Applicant: Enfant Terrible Design AB, Norrtälje (SE)

(72) Inventor: Lisa Furuland, Norrtälje (SE)

(73) Assignee: ENFANT TERRIBLE DESIGN AB, Stockholm (SE)

( * ) Notice: Subject to any disclaimer, the term of this patent is extended or adjusted under 35 U.S.C. 154(b) by 0 days.

(21) Appl. No.: 16/837,064

(22) Filed: Apr. 1, 2020

(65) Prior Publication Data

US 2020/0318378 A1 Oct. 8, 2020

Related U.S. Application Data

(60) Provisional application No. 62/828,631, filed on Apr. 3, 2019.

(51) Int. Cl.

| | |
|---|---|
| ***E04H 15/56*** | (2006.01) |
| ***A47D 9/00*** | (2006.01) |
| ***A47D 15/00*** | (2006.01) |
| ***E04H 15/40*** | (2006.01) |
| ***E04H 15/32*** | (2006.01) |

(52) U.S. Cl.

CPC ..... *E04H 15/56* (2013.01); *A47D 9/005* (2013.01); *A47D 15/001* (2013.01); *E04H 15/324* (2013.01); *E04H 15/40* (2013.01)

(58) Field of Classification Search

CPC ..... A47D 9/005; A47D 15/003; A47D 7/002
USPC ..... 5/418
See application file for complete search history.

(56) References Cited

U.S. PATENT DOCUMENTS

| | | | |
|---|---|---|---|
| 368,206 | A | 8/1887 | Hardy |
| 2,626,407 | A | 1/1953 | Kurry |
| 2,633,898 | A | 4/1953 | Arthur |
| 2,961,802 | A | 11/1960 | Mongan et al. |
| 3,583,765 | A | 6/1971 | Wallis |
| 3,761,975 | A | 10/1973 | Personett |

(Continued)

FOREIGN PATENT DOCUMENTS

| | | | |
|---|---|---|---|
| DE | 20007258 | U1 | 10/2000 |
| FR | 2911776 | A1 | 8/2008 |

OTHER PUBLICATIONS

PCT International Search Report and Written Opinion from PCT/IB2012/002888 dated Aug. 2, 2013.

(Continued)

*Primary Examiner* — Noah Chandler Hawk
(74) *Attorney, Agent, or Firm* — Ward and Smith, P.A.; Ryan K. Simmons

(57) ABSTRACT

A foldable canopy and method of use. The foldable canopy may include a foldable base portion having a first end, a second end opposite the first end, a first side, and a second side opposite the first side and substantially parallel therewith; a foldable canopy portion having a first end, a second end opposite the first end, a first side, and a second side opposite the first side; and wherein the first end of the foldable canopy portion may be attached to the first side of the foldable base portion and the second end of the foldable canopy portion may be attached to the second side of the foldable base portion, and wherein the foldable canopy portion may be attached to the foldable base portion such that in an unfolded state the foldable canopy portion is substantially arch shaped.

20 Claims, 9 Drawing Sheets

(56) References Cited

U.S. PATENT DOCUMENTS 4,043,349 A 8/1977 Gays
D263,192 S 3/1982 LeVan
4,383,713 A 5/1983 Roston
4,607,402 A 8/1986 Pollard
D288,757 S 3/1987 Hoeckel
D298,768 S 11/1988 Dwosh et al.
4,788,726 A 12/1988 Rafalko
4,802,244 A 2/1989 McGrath-Saleh
4,810,030 A 3/1989 Lewis
4,951,333 A * 8/1990 Kaiser ..... A47G 9/062 135/126
4,972,864 A 11/1990 Almond
D317,232 S 6/1991 Vogtherr et al.
5,024,262 A 6/1991 Huang
D318,706 S 7/1991 Norman
5,035,013 A 7/1991 Bloom
5,056,172 A 10/1991 Kaiser et al.
5,088,139 A 2/1992 Bloom
D325,836 S 5/1992 Morton
5,137,333 A 8/1992 Chee
5,163,461 A 11/1992 Ivanovich et al.
5,165,130 A 11/1992 Wendling
D333,389 S 2/1993 Saito et al.
5,242,338 A 9/1993 Hartdegen et al.
D341,407 S 11/1993 Mcleese
5,299,883 A 4/1994 Arth
5,337,772 A 8/1994 Habchi
5,392,785 A 2/1995 Donahue
5,448,790 A 9/1995 Saro et al.
5,519,906 A 5/1996 Fanto-Chan
5,551,109 A 9/1996 Tingley et al.
5,586,351 A 12/1996 Ive
D380,274 S 6/1997 Stamets
5,642,538 A 7/1997 McAllister
5,642,750 A 7/1997 Brown
D393,772 S 4/1998 Vingino
5,813,066 A 9/1998 Gebhard et al.
D400,949 S 11/1998 Gale
D404,216 S 1/1999 Gerhart
D404,597 S 1/1999 Chavez et al.
5,862,548 A 1/1999 Gerhart
D410,153 S 5/1999 McAllister
D412,354 S 7/1999 Takos
5,928,054 A 7/1999 Mast
5,930,854 A 8/1999 O'Neill
D415,919 S 11/1999 Porter
5,992,045 A 11/1999 Kellogg et al.
6,014,837 A 1/2000 Morgan
6,047,420 A 4/2000 Priester et al.
D426,091 S 6/2000 White
6,073,283 A 6/2000 Zheng
D429,923 S 8/2000 Meglino et al.
6,098,349 A * 8/2000 Zheng ..... E04H 15/40 52/116
6,109,282 A 8/2000 Yoon
6,170,100 B1 1/2001 Le Gelle et al.
6,199,229 B1 * 3/2001 Wong ..... E04H 15/006 135/125
D441,040 S 4/2001 Cho
D450,516 S 11/2001 Darling
6,356,439 B1 3/2002 Schmidt
6,357,462 B1 3/2002 Laosunthara et al.
6,357,510 B1 3/2002 Zheng
6,363,955 B1 4/2002 Louie
D465,585 S 11/2002 Venegas
6,478,038 B1 11/2002 Le et al.
6,505,366 B1 1/2003 Lied
6,536,058 B1 3/2003 Chang
6,571,410 B2 6/2003 Zheng
6,588,036 B1 7/2003 Hort
6,594,840 B2 7/2003 Tomas et al.
6,701,547 B2 3/2004 Hsia
6,810,545 B1 11/2004 Darling et al.
6,851,136 B2 2/2005 Brereton
6,881,114 B2 4/2005 Zheng
6,901,940 B2 6/2005 Zheng
7,048,333 B2 5/2006 Martinez
D534,615 S 1/2007 van Aalst
7,225,822 B1 6/2007 Zheng
7,234,199 B2 6/2007 Bushey
7,302,724 B2 12/2007 Solomon et al.
7,302,957 B2 * 12/2007 Ross ..... E04H 15/40 135/117
7,404,219 B2 7/2008 Berkey
7,575,011 B2 8/2009 Zheng
7,588,291 B2 9/2009 Gold et al.
D602,266 S 10/2009 Hagstrom
7,676,871 B1 3/2010 Leach
7,766,367 B2 8/2010 Dotsey et al.
7,836,906 B2 11/2010 Zheng
7,926,135 B1 4/2011 Leach
8,024,829 B2 9/2011 Carr et al.
D646,741 S 10/2011 Akaka
D652,712 S 1/2012 Bushey
D655,518 S 3/2012 Sclare
D666,843 S 9/2012 Furuland
D673,789 S 1/2013 Furuland
D673,790 S 1/2013 Furuland
D673,791 S 1/2013 Furuland
D677,910 S 3/2013 Shaw
8,419,128 B1 4/2013 Leach
8,458,830 B1 6/2013 Pierce et al.
8,464,379 B1 * 6/2013 Zajac ..... A61G 1/04 5/629
8,555,429 B2 10/2013 Leach
8,667,626 B2 3/2014 Zheng
D716,896 S 11/2014 Blackwood
8,882,557 B2 11/2014 Fair
D763,391 S 8/2016 Xu
9,464,646 B2 10/2016 Burns et al.
D773,579 S 12/2016 Shir
D774,879 S 12/2016 Martinson
D775,296 S 12/2016 Shir et al.
9,644,390 B1 5/2017 Garvens et al.
D813,583 S 3/2018 Furuland
D825,706 S 8/2018 Xiao
D828,698 S 9/2018 Furuland
2003/0093859 A1 5/2003 Roudebush
2004/0064887 A1 4/2004 Cheng
2004/0131801 A1 * 7/2004 Wong ..... A45F 4/04 428/12
2005/0076444 A2 4/2005 Houghteling
2005/0121061 A1 * 6/2005 Zheng ..... E04H 15/56 135/126
2005/0155155 A1 7/2005 Kassai et al.
2005/0172408 A1 8/2005 Temple
2005/0172411 A1 8/2005 Snedeker
2005/0210591 A1 9/2005 Mead et al.
2006/0026766 A1 2/2006 Brewin
2006/0117478 A1 6/2006 Cheung
2007/0028358 A1 * 2/2007 Baek ..... A45B 23/00 2/171
2007/0245494 A1 10/2007 Dockendorf
2007/0256242 A1 11/2007 Warnock
2008/0040854 A1 2/2008 Lorentz
2008/0182477 A1 7/2008 Catelli
2008/0213039 A1 9/2008 Chen et al.
2009/0083908 A1 4/2009 Fry
2009/0151080 A1 6/2009 Lord
2009/0205140 A1 8/2009 Reese et al.
2009/0222993 A1 9/2009 Villanueva et al.
2011/0119833 A1 5/2011 Clark
2011/0191956 A1 8/2011 Rabess et al.
2011/0277210 A1 11/2011 Hardesty
2012/0062001 A1 * 3/2012 Krasley ..... B60N 2/2845 297/184.13
2012/0261962 A1 10/2012 Huntsberger et al.
2012/0317716 A1 12/2012 Tricault et al.
2013/0111661 A1 5/2013 Furuland
2014/0259359 A1 9/2014 Yaari et al.
2014/0273719 A1 9/2014 Weisman
2015/0330549 A1 11/2015 Drane
2016/0324324 A1 11/2016 Wilkerson Altonen

(56) References Cited

U.S. PATENT DOCUMENTS

| | | | | |
|---|---|---|---|---|
| 2017/0013970 | A1 | 1/2017 | Furuland | |
| 2017/0252662 | A1* | 9/2017 | Elson | A63H 33/008 |
| 2018/0263373 | A1* | 9/2018 | Arias | A47L 1/00 |

OTHER PUBLICATIONS

Change Pad with Toy Bar, Babyhaven.com, reviewed May 6, 2013, site visited Jun. 16, 2017, available online <URL: https://www.babyhaven.com/summer-infant-change-pad-with-flower-flutter-toy-bar-girl.html>.

Mombo Play Toy Bar, Diary of a Working Mom, Mar. 14, 2014, site visited Jun. 16, 2017, available online <URL:http://www.diaryofaworkingmom.com/2014/03/14/comfort-harmony-mombo-toy-bar-review/>.

EquiptBaby bassinet, From Downriver to Downright Country blog, Jan. 29, 2015, site visited Apr. 13, 2017, available online <URL:https://fromdownrivertodownrightcountry.wordpress.com/page/3/>.

International Search Report and Written Opinion received for PCT Patent Application No. PCT/EP2020/059222, dated May 28, 2020, 14 pages.

* cited by examiner

FOLDABLE CANOPY AND METHOD OF USING SAME

RELATED APPLICATIONS

This application claims priority to and is related to U.S. Provisional Patent Application No. 62/828,631, entitled "Infant Bed Sun Canopy" filed on Apr. 3, 2019, the application of which is incorporate herein by reference in its entirety.

TECHNICAL FIELD

The subject matter of the invention relates generally to a canopy, and more particularly to a foldable canopy attachment with netting for a juvenile lounger.

BACKGROUND

Although many of the sun's worst effects do not appear until later in life, medical research has shown that it is imperative to protect children from over-exposure to ultraviolet (UV) radiation. It is well known that over-exposure to UV radiation can cause skin cancer. Thus, in the early years of childhood, a child's delicate eyes, skin, and body need adequate protection from the harmful effects of the sun's heat, glare, and cancer causing UV rays. While some child car seats, child carriers, juvenile loungers may provide some cover to protect the child from the sun, a drawback of these covers is that they can be inconvenient to carry and install. Further, there may be a need to protect the child from insects as well as sun.

Therefore there is a need for an apparatus that can be attached to a juvenile lounger that can provide protection from the elements, such as sun and insects.

SUMMARY

In one embodiment, a foldable canopy is provided. The foldable canopy may include a foldable base portion having a first end, a second end opposite the first end, a first side, and a second side opposite the first side and substantially parallel therewith; a foldable canopy portion having a first end, a second end opposite the first end, a first side, and a second side opposite the first side; and wherein the first end of the foldable canopy portion may be attached to the first side of the foldable base portion and the second end of the foldable canopy portion may be attached to the second side of the foldable base portion, and wherein the foldable canopy portion may be attached to the foldable base portion such that in an unfolded state the foldable canopy portion is substantially arch shaped. The foldable canopy portion may be attached to the foldable base portion such that the arch shape is formed over a portion of the foldable base portion proximate its first end. The foldable canopy may further include a netting material attached to a portion of either or both of the first side and second side of the foldable canopy portion. The foldable canopy may further include one or more pockets disposed along a portion of either or both of the first side and second side of the foldable canopy portion, and wherein the pockets may be configured to store the netting material when not in use. The one or more pockets may include a re-closeable closure mechanism. The netting material may include a vertical re-closeable opening. The netting material may include an elastic band integrated about a periphery of an end portion of the netting material opposite that of an end portion that attaches to the foldable arch portion. The elastic band may be configured to retain the end portion of the netting material in place about an outer portion of the juvenile lounger. The foldable canopy portion may further include a foldable visor foldabley attached to the first side of the foldable canopy portion. The foldable visor may be foldable between a deployed position and a retracted position, wherein in the deployed position the foldable visor may extend out from a side most edge of the first side of the foldable canopy portion. The foldable canopy, in the retracted position, may fold underneath an underside of the foldable canopy portion. The foldable visor may be positioned at about a midpoint along a side most edge of the first side of the foldable canopy portion. The foldable base portion may include a base floor and a skirt body, wherein the skirt body is attached at its bottom edge about a periphery of the base floor. The skirt body may include an elastic band integrated about its upper periphery. The base floor may be configured to accommodate a juvenile lounger thereon, and wherein the elastic band of the skirt body may be configured to hold the skirt body in place around a bottom outer portion of the juvenile lounger installed atop the base floor. The base floor may include a resilient frame member confined in a substantially ovular shape by a fabric body. The foldable canopy portion may include a resilient frame member confined by a fabric body. The foldable base portion and the foldable canopy portion may be configured to be folded into a common generally flat circular state for storage.

In another embodiment, a method of installing a foldable canopy to a juvenile lounger is provided. The method may include, providing a foldable canopy in a folded stored state. The foldable canopy may include a foldable base portion having a first end, a second end opposite the first end, a first side, and a second side opposite the first side and substantially parallel therewith; a foldable canopy portion having a first end, a second end opposite the first end, a first side, and a second side opposite the first side; and wherein the first end of the foldable canopy portion may be attached to the first side of the foldable base portion and the second end of the foldable canopy portion may be attached to the second side of the foldable base portion, and wherein the foldable canopy portion may be attached to the foldable base portion such that in an unfolded state the foldable canopy portion is substantially arch shaped. The method may further include, removing the foldable canopy from a storage bag, wherein the foldable canopy maybe configured to automatically unfolded upon removal from the storage bag; and inserting a juvenile lounger atop the foldable base portion. The foldable base portion may include a base floor and a skirt body, wherein the skirt body may be attached at its bottom edge about a periphery of the base floor, and may include an elastic band integrated about its upper periphery. The method may further include positioning the skirt body about a lower outer perimeter of the juvenile lounger, wherein the elastic band of the skirt body may be configured to hold the positioned skirt body in place. The method may further include extending a netting material attached to the foldable canopy portion and positioning a bottom portion of the netting material about an outer portion of the juvenile lounger, wherein an elastic band integrated about the periphery of the bottom portion of the netting material may be configured to hold the positioned netting material in place.

In yet another embodiment, a method of storing a foldable canopy is provided. The method may include, removing the foldable canopy from a juvenile lounger. The foldable canopy may include a foldable base portion having a first end, a second end opposite the first end, a first side, and a second side opposite the first side and substantially parallel therewith; a foldable canopy portion having a first end, a second end opposite the first end, a first side, and a second side opposite the first side; and wherein the first end of the foldable canopy portion may be attached to the first side of the foldable base portion and the second end of the foldable canopy portion may be attached to the second side of the foldable base portion, and wherein the foldable canopy portion may be attached to the foldable base portion such that in an unfolded state the foldable canopy portion is substantially arch shaped. The method may further include folding the foldable canopy into a generally flat circular state; and inserting the folded foldable canopy into a storage bag configured to receive the folded foldable canopy.

BRIEF DESCRIPTION OF THE DRAWINGS

Figure 1:
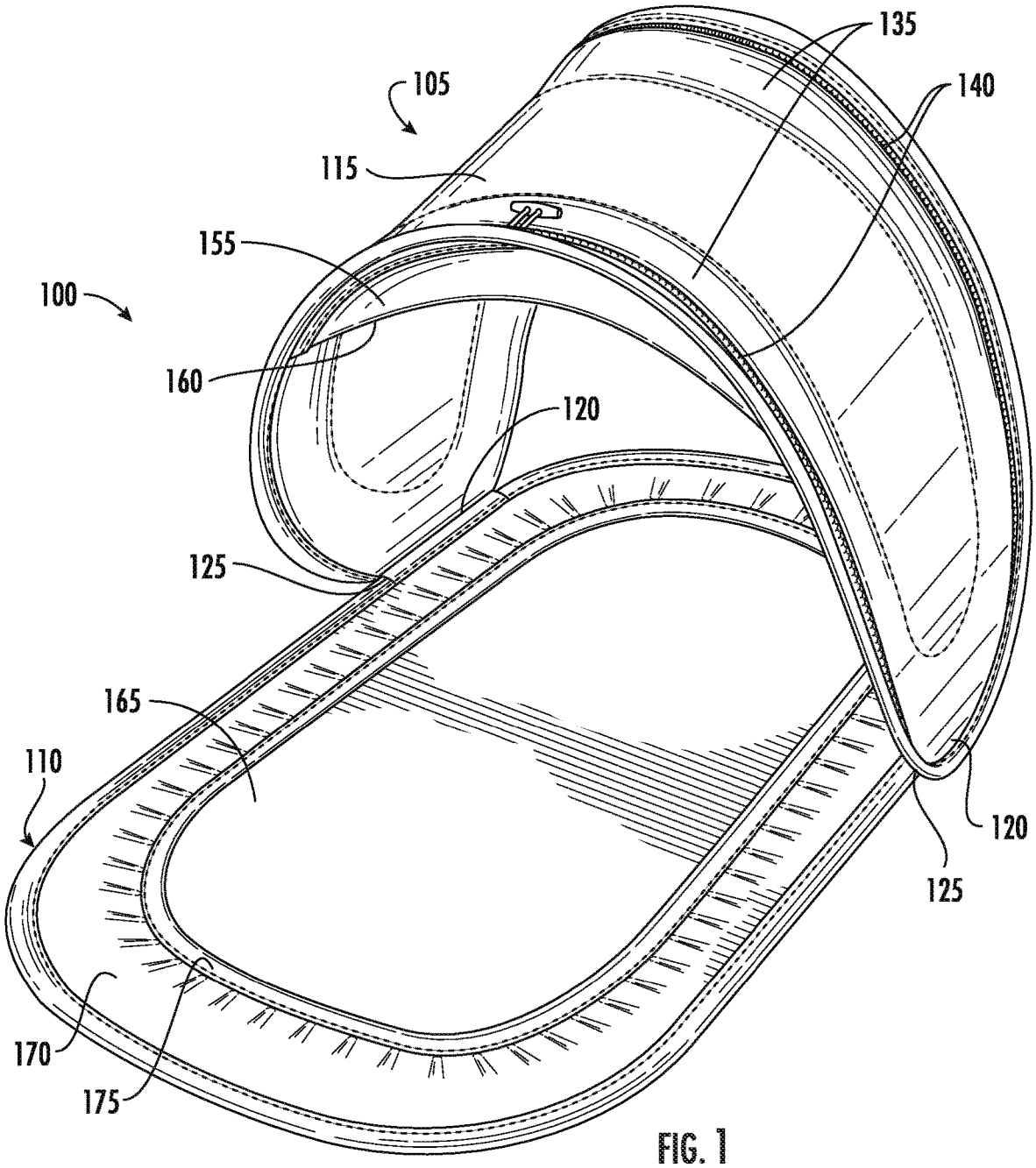
Figure 2:
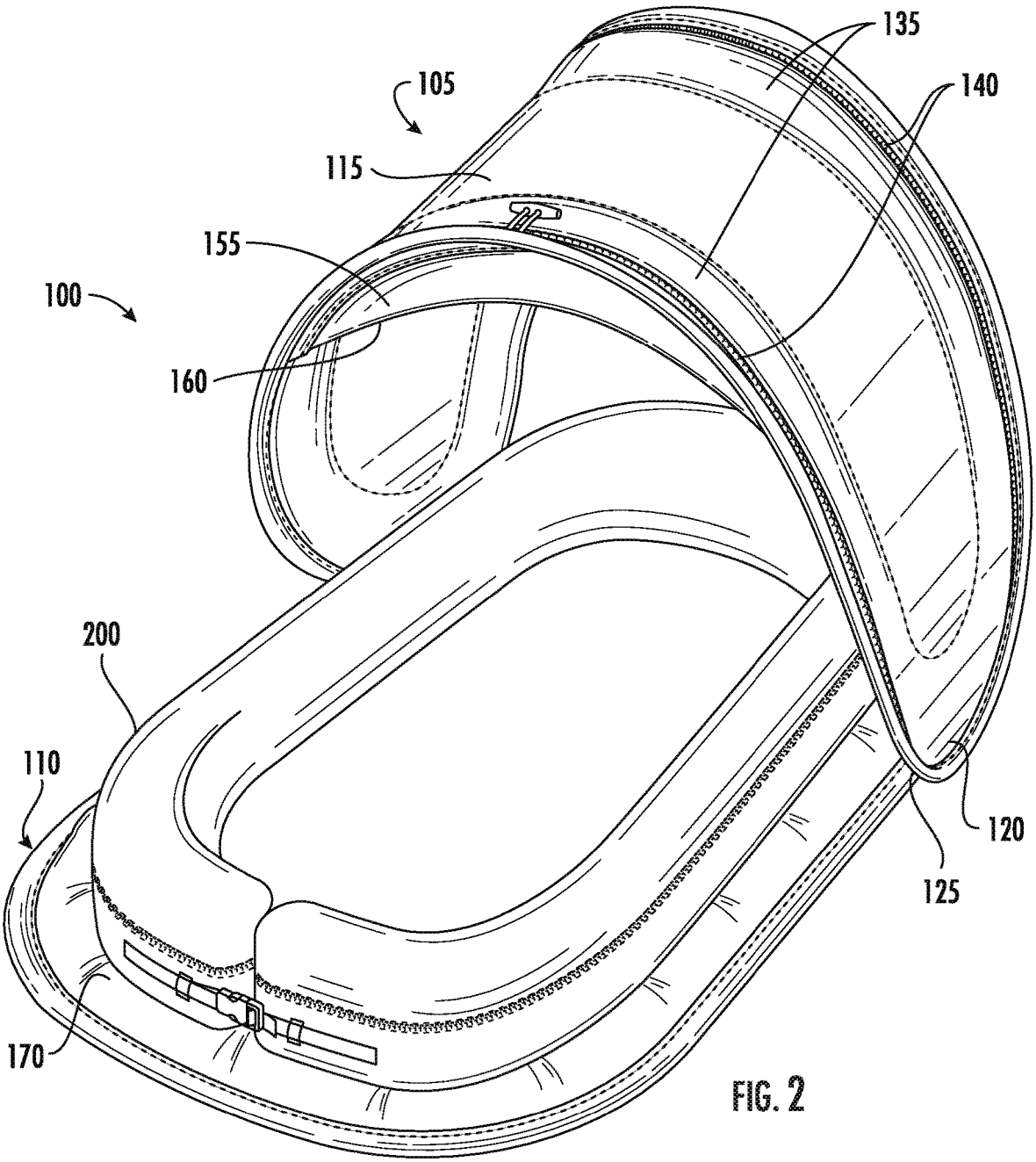
Figure 3:
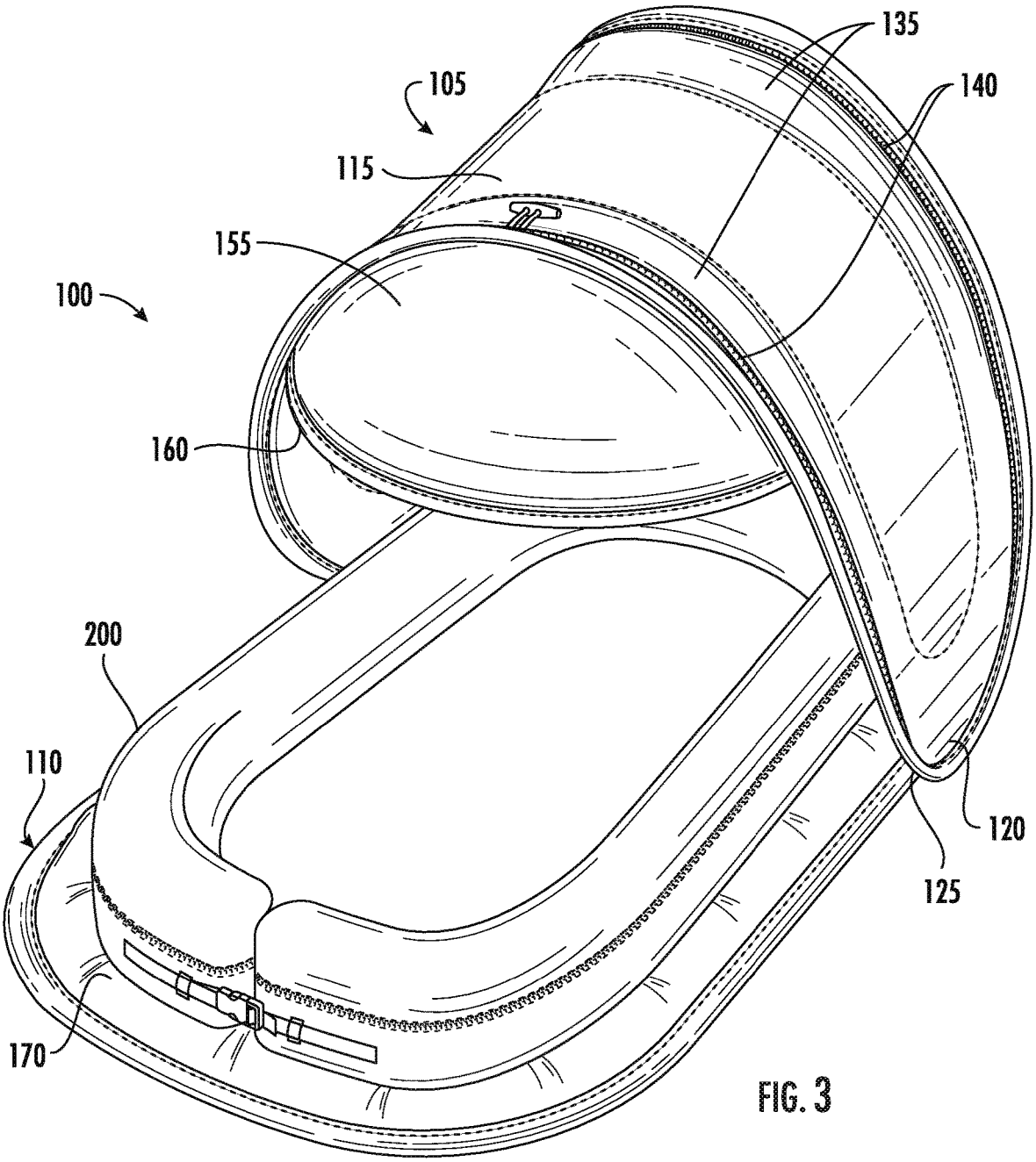
Figure 4:
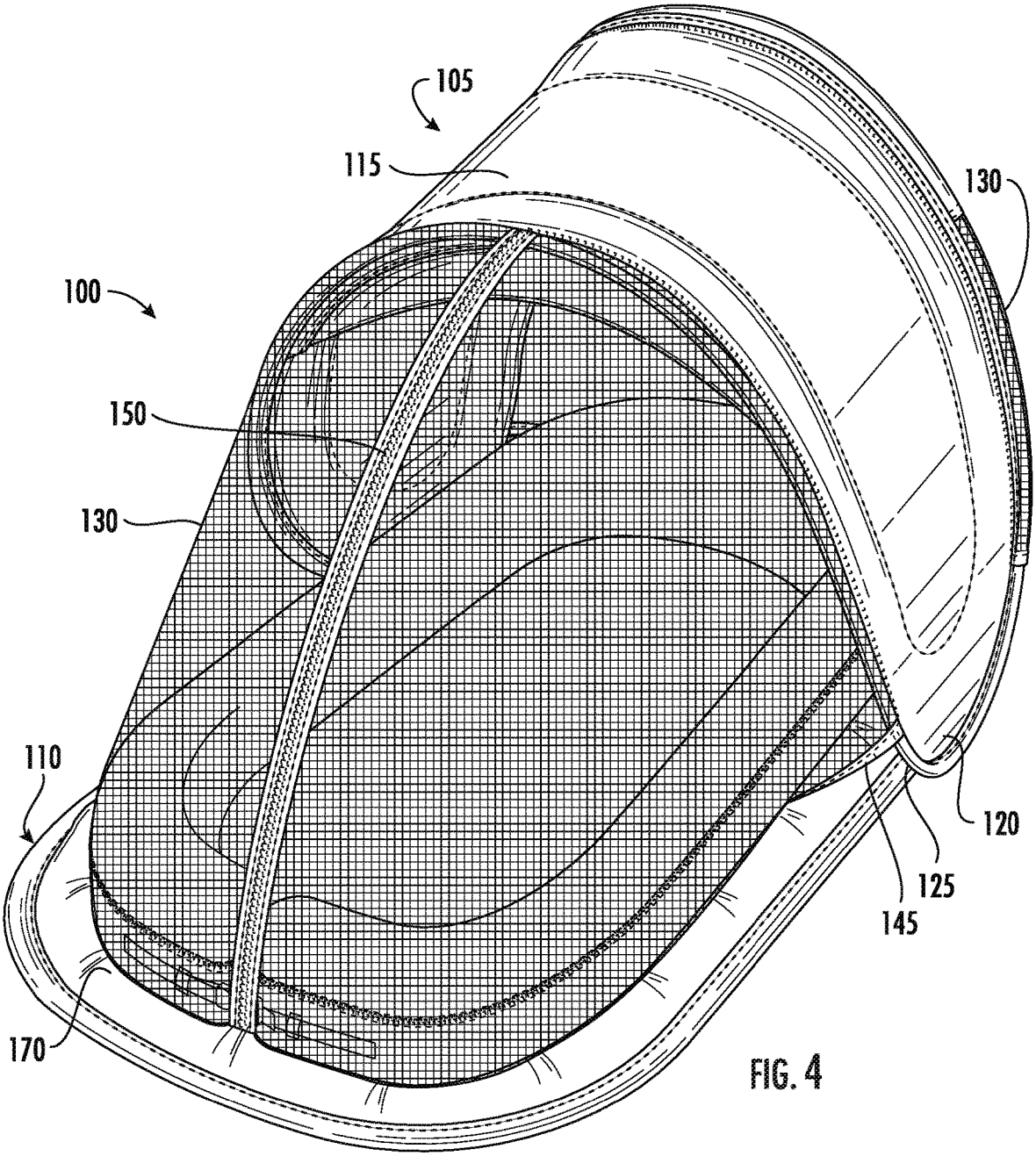
Figure 5:
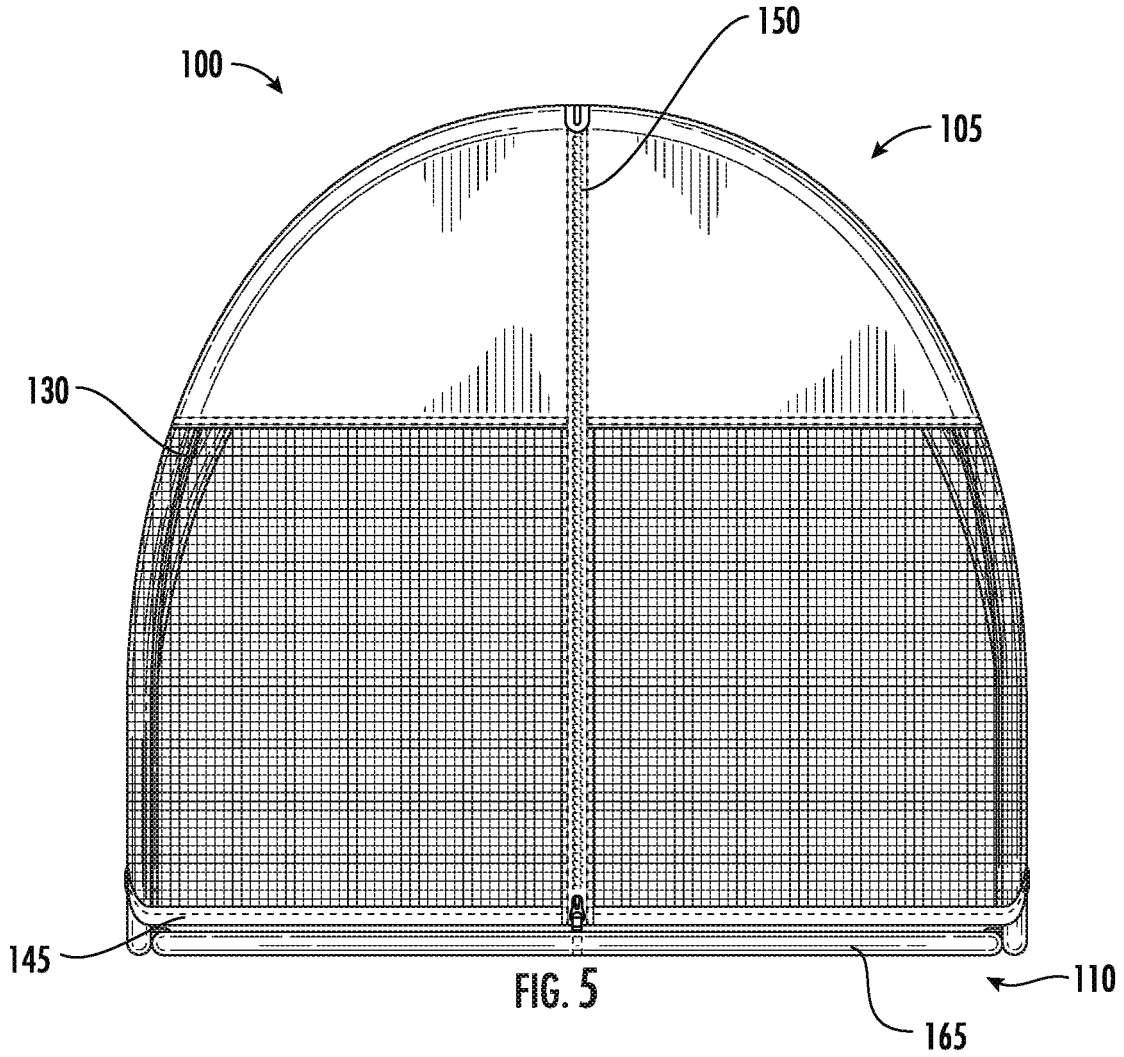
Figure 6:
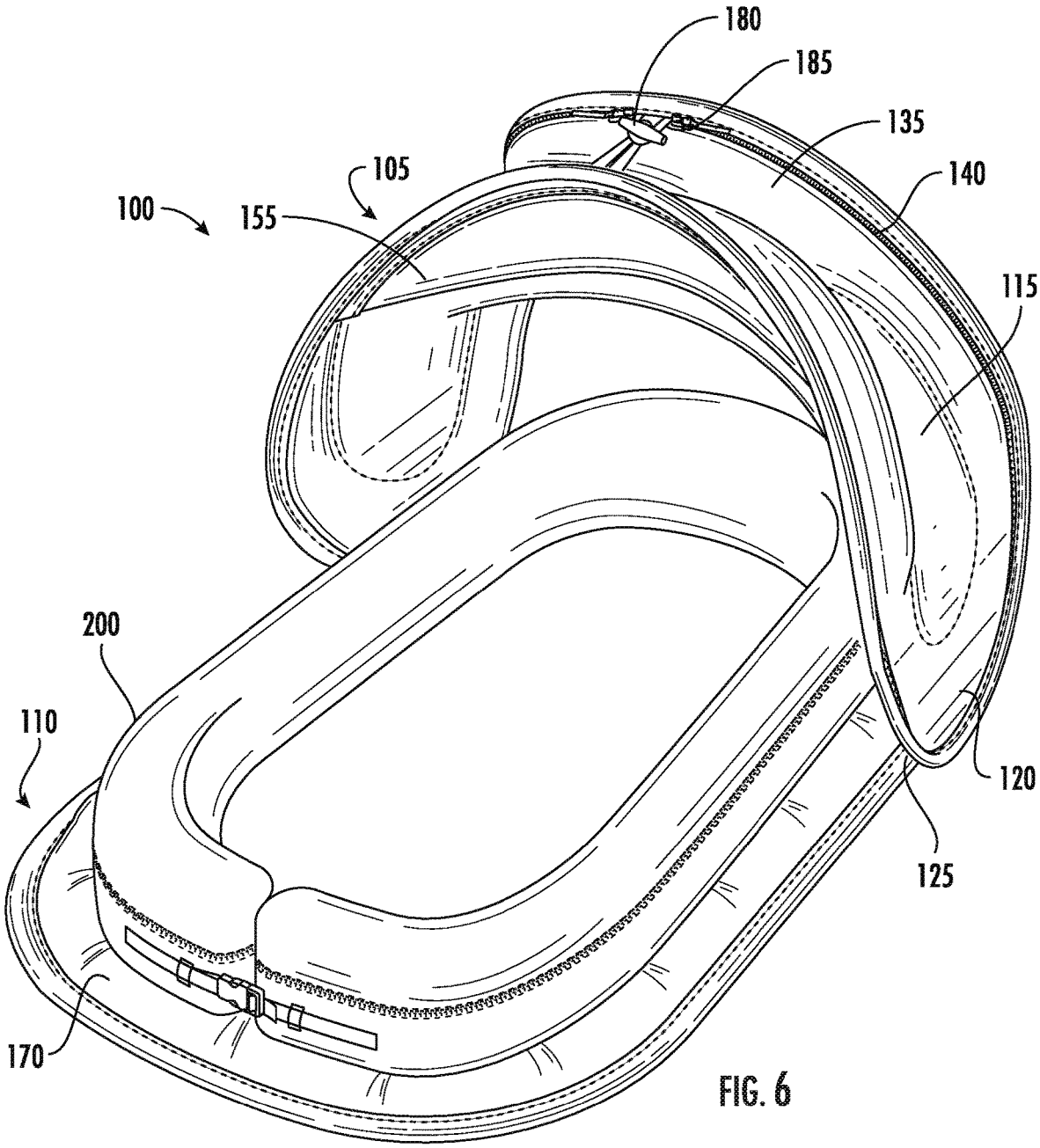
Figure 7A:
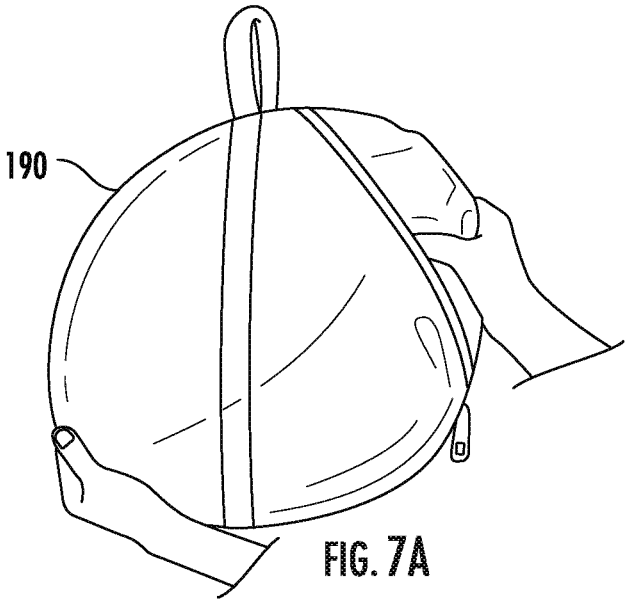
Figure 7B:
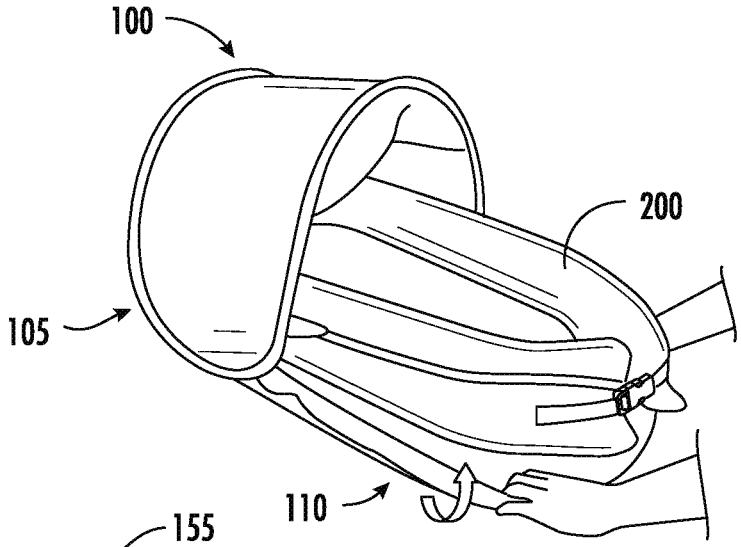
Figure 7C:
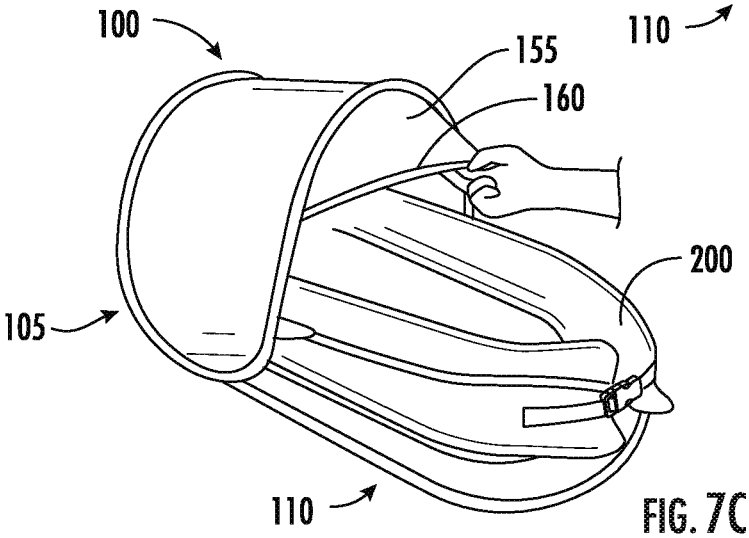
Figure 7D:
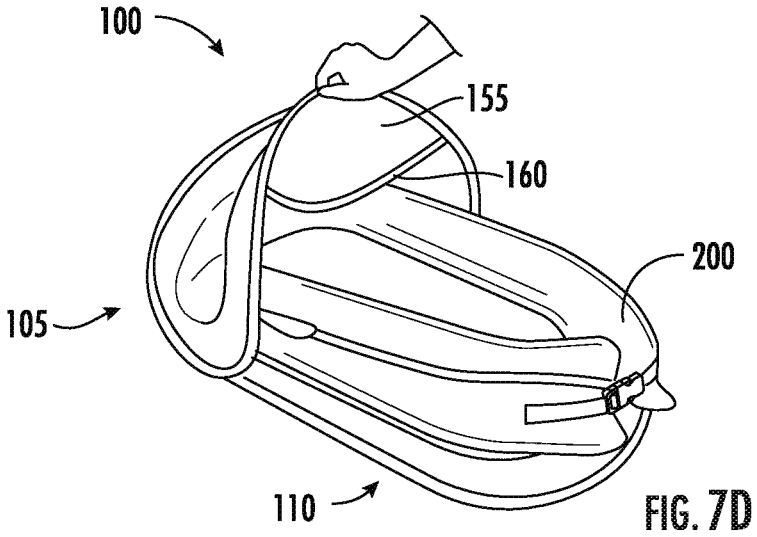
Figure 7E:
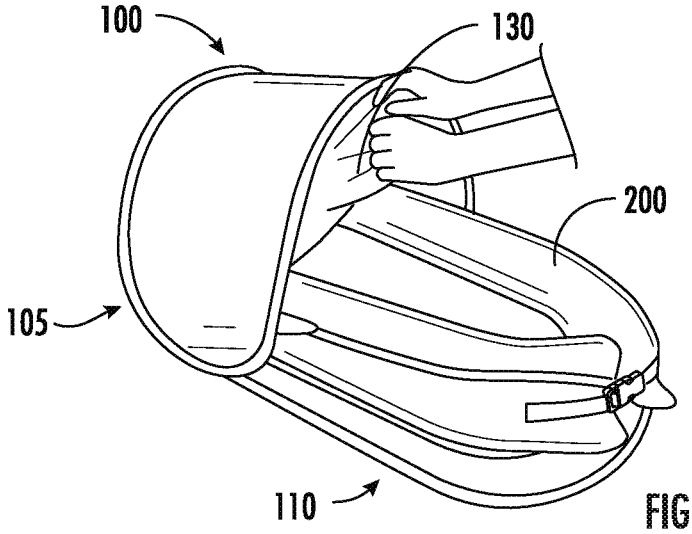
Figure 7F:
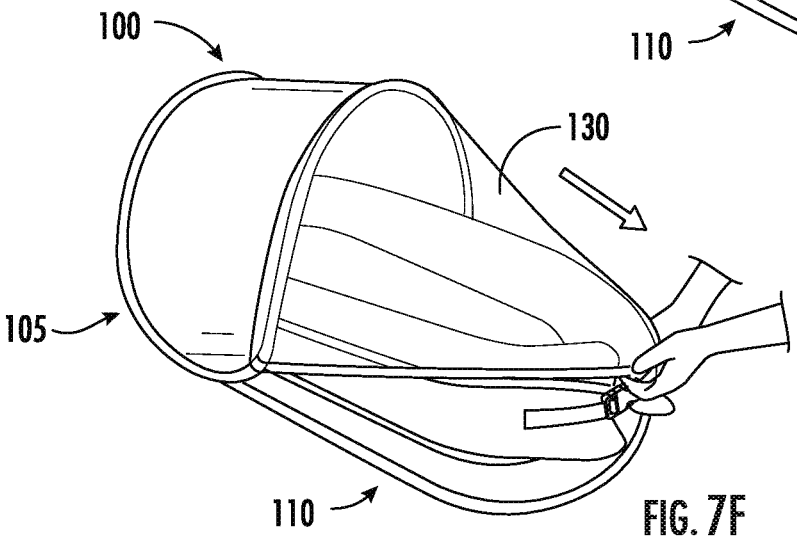
Figure 8A:
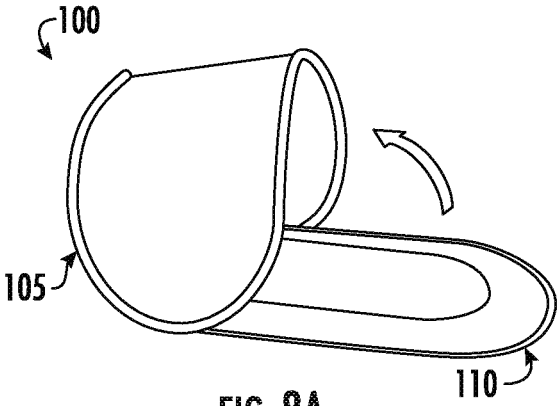
Figure 8B:
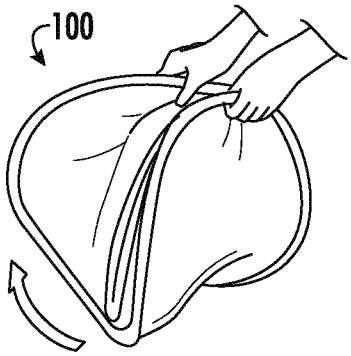
Figure 8C:
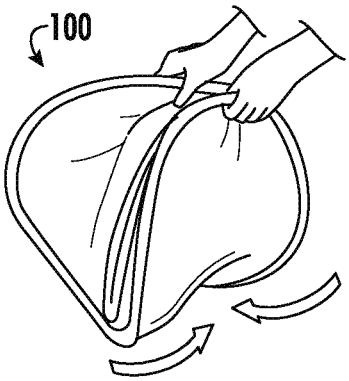
Figure 8D:
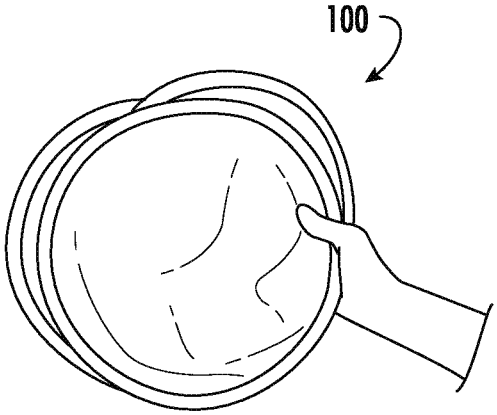
Figure 8E:
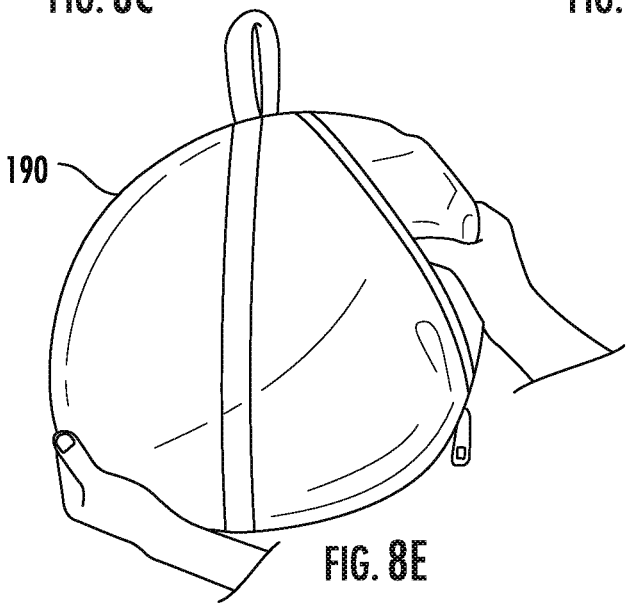

Having thus described the subject matter of the canopy in general terms, reference will now be made to the accompanying Drawings, which are not necessarily drawn to scale, and wherein:

FIG. 1 illustrates a perspective view of an example foldable canopy in accordance with an embodiment of the invention;

FIG. 2 illustrates another perspective view of the foldable canopy in accordance with an embodiment of the invention;

FIG. 3 illustrates another perspective view of the foldable canopy of FIG. 2 with a visor extended;

FIG. 4 illustrates another perspective view of the foldable canopy of FIG. 2 with a netting deployed;

FIG. 5 illustrates a rear view of the foldable canopy of FIG. 4;

FIG. 6 illustrates another perspective view of the foldable canopy of FIG. 2 with the canopy arch retracted;

FIGS. 7A, 7B, 7C, 7D, 7E, and 7F illustrate an example of a process of installing and using the presently disclosed foldable canopy on a baby lounger; and FIGS. 8A, 8B, 8C, 8D, and 8E illustrate an example of a process of folding the presently disclosed foldable canopy for storage.

DETAILED DESCRIPTION

The subject matter of the invention will now be described more fully hereinafter with reference to the accompanying Drawings and Appendices (the entire contents of which are herein incorporated by reference), in which some, but not all embodiments of the presently disclosed subject matter are shown. Like numbers refer to like elements throughout. The subject matter of the invention may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the subject matter of the invention is not to be limited to the specific embodiments disclosed and that modifications and other embodiments are intended to be included within the scope of the appended claims.

In some embodiments, the subject matter of the invention may provide a foldable canopy for use with a juvenile lounger, such as for example the DockATot® Deluxe+ baby lounger. Referring now to FIGS. 1-6 are various views of an example of the presently disclosed foldable canopy 100, which may be installed on a juvenile lounger 200 (as shown in FIG. 2). Canopy 100 is preferably a portable, attachable, detachable foldable canopy device for use in combination with, for example, the juvenile lounger 200. The juvenile lounger 200 may be a child-sized or infant-sized portable lounger, pod, mattress, or pad (generically referred to herein as a "juvenile lounger").

In one embodiment, foldable canopy 100 may include a foldable canopy arch 105 and a foldable canopy base 110. Foldable canopy arch 105 may include a fabric body 115 installed on a leaf spring member (not shown). The leaf spring member may be made of a flexible hoop or ring formed of, for example, metal, plastic, or other suitable material. In a relaxed state, the leaf spring member may be of a generally ovular shape, as constrained by the pattern of the fabric body 115, wherein the edges of the fabric body 115 may be folded over and stitched around the leaf spring member, or otherwise suitably constrained about the perimeter of the fabric body 115. The fabric body 115 may be formed of any lightweight, flexible, durable, UV protective (e.g., 50+UV SPF), and preferably substantially waterproof or water resistant material. For example, the fabric body 115 may be formed of polyester, polyvinyl chloride (PVC)-coated polyester, vinyl-coated polyester, nylon, canvas, PVC-coated canvas, polycotton canvas, and/or any other suitable material. Ends 120 of the foldable canopy arch 105 may be attached to opposing side portions 125 of the foldable canopy base 110 by stitching, or other suitable mechanism or technique, thereby holding the foldable canopy arch 105 in an arched (bowed) position extending over a portion of foldable canopy base 110 when in an unfolded open state. In an example, when in an unfolded open state, the foldable canopy arch may extend over a portion of the foldable canopy base 110, such that when installed on a juvenile lounger 200, the foldable canopy arch 105 extends over at least a portion of the juvenile lounger where a head of a juvenile, such as an infant/baby, would be positioned.

Foldable canopy arch 105 may also include netting 130, e.g., an insect netting. A pocket 135 may be provided on each side of the foldable canopy arch 105 for storing and then deploying the netting 130. Pocket 135 may be for example a zipper-closed pocket or other closeable/openable type pocket, and may include a zipper 140, or other suitable type of easy closure/opening mechanism. In one example, one pocket 135 may be along a front portion of the fabric body 115 of the foldable canopy arch 105 for holding/releasing a forward-facing netting 130. Likewise, another pocket 135 may be along a rear portion of the fabric body 115 of the foldable canopy arch 105 for holding/releasing a rear-facing insect netting 130. Pockets 135 may be along an edge of, bottom side, or top side of the front and/or rear facing portion of the fabric body 115 of the foldable canopy arch 105. Once deployed, the netting 130 may be folded under or around an outer portion of the juvenile lounger 200 to enclose an infant/baby lying therein. The netting 130 may include an elastic band 145 integrated about its bottom periphery to facilitate holding the bottom portion of the netting 130 in place under or around a perimeter of the juvenile lounger 200 (e.g., in a groove formed where the bumper portion and bottom mattress pad of the juvenile lounger 200 meet). The netting 130 may further include a vertical zippered opening 150 (or other type openable/closeable opening), in the front and/or rear facing portion of the netting 130 to allow easy access to an infant/baby lying therein when the netting 130 is deployed. In canopy 100, the presence of netting 130 and therefore pockets 125 may be optional.

Foldable canopy arch 105 may further include a visor 155. The visor 155 may be provided on a front portion of the fabric body 115 of the foldable canopy arch 105. The visor 155 may be configured such that it can be pulled forward (deployed) for added sun protection or pushed back (retracted) when not in use/needed. The visor 155 may be made of the same or similar material as that of the fabric body 115, and may include a resilient front edge portion 160, e.g., similar to the leaf spring material about the perimeter of the fabric body 115, or made of other suitable material to allow for the visor 155 to support itself while being easily deployed and retracted.

The foldable canopy base 110 may include a base floor 165 and a protective skirt 170. The base floor 165 may include a fabric body similar to that of fabric body 115, in that it is also installed on a flexible leaf spring member (not shown), made of a flexible hoop or ring formed of, for example, metal, plastic, or other suitable material. The base floor 165 may be of a generally ovular shape, and of a length and width substantially the same or similar to that of the infant/baby lounger 200 which it may be installed on. In one example, the base floor 165 has a length and width equal to or greater than the juvenile lounger 200 which it is installed on. Protective skirt 170, at its bottom edge, is attached (e.g., stitched) to and preferably extends about a perimeter of the base floor 165. The protective skirt 170 may include an elastic band 175 integrated about its upper periphery to facilitate holding the protective skirt 170 in place around a bottom outer portion of the juvenile lounger 200. For example, the elastic band 175 may fold into a groove formed where the bottom mattress pad and bumper portion of the juvenile lounger 200 meet. The base floor 165 and the protective skirt 170 are preferably formed of a substantially water resistant or waterproof material. In one embodiment, the leaf spring member of the foldable canopy arch 105 and foldable canopy base 110 may be a single continuous resilient member (e.g., wire) that transfers from the foldable canopy arch 105 to the foldable canopy base 110. In such an embodiment the single continuous resilient member may transfer from the foldable canopy arch 105 to the foldable canopy base 110 at the portion of the foldable canopy 100 where the foldable canopy arch 105 is attached to the foldable canopy base 110, and may take on somewhat of a FIG. 8 shape. In another embodiment the foldable canopy arch 105 and foldable canopy base 110 may have their own separate leaf spring like member.

Foldable canopy arch 105 of foldable canopy 100 may be retractable, for example to make it easier to place a baby/infant into, or remove from, the juvenile lounger 200. In one example, to retract the foldable canopy arch 105, the front portion of the foldable canopy arch 105 is pulled back toward the rear portion of the foldable canopy arch 105. Once pulled back the front portion and rear portion of the foldable canopy arch 105 may be attached together via a toggle 180 on the front top portion of the foldable canopy arch 105 to a fabric loop 185 at the rear top portion of the foldable canopy arch 105. The location of toggle 180 and fabric loop 185 may be reversed, that is toggle 180 may be on the rear top portion of the foldable canopy arch 105 and the fabric loop 185 may be at the front top portion of the foldable canopy arch 105. Further, the front and back portions of the foldable canopy arch 105 are not limited to only being attached together via toggle 180 and fabric loop 185. The front and back portions of the foldable canopy arch 105 may be attached via any suitable technique or mechanism, including but not limited to, snaps, hook and loop, ties, clips, magnets, and/or the like.

FIGS. 7A-7F show an example of a process of installing the presently disclosed foldable canopy 100 to the juvenile lounger 200, as well as other features of the foldable canopy 100. For example, as an initial step, foldable canopy 100 may be removed from a storage bag 190. Due to the presence of the leaf springs, foldable canopy 100, when removed from storage bag 190, automatically pops open to its full unfolded state. The juvenile lounger 200 may then be inserted atop the base floor 165 of the foldable canopy base 110 and the protective skirt 170 may be pulled up and elastic band 175 of the protective skirt 170 may be pulled around a lower outer perimeter of the juvenile lounger 200. In one example, the elastic band 175 may be folded into the groove formed between where the bottom mattress pad and bumper portion of the juvenile lounger 200 meet, thus holding the protective skirt 170 up around the lower outer portion of the infant/baby lounger 200.

With reference to FIGS. 8A-8E, foldable canopy 100 may further be foldable for ease of storage and transport when not in use. In one embodiment, foldable canopy 100 may be foldable into a generally flat circular state for storing in storage bag 190. For example, FIG. 8 shows an example of a process of folding the presently disclosed foldable canopy 100 for storage. Namely, the foldable canopy 100 may be folded easily into multiple small circles. In one example, to fold foldable canopy 100 for storage in storage bag 190, the ends of the foldable canopy arch 105 and foldable canopy base 110 may be pulled together forming two hoops. Next the two formed hoops may be folded on top of each other so they overlap, and due to the spring action of the leaf spring members, the foldable canopy 100 automatically configures into small substantially flat circles. The foldable canopy 100 may then be inserted into the storage bag 190 and zipped, or otherwise closed. Foldable Canopy 100 may further include folding cues (not shown), such as, but not limited to, numbers, letters, graphics, and the like, to aid in the folding of the foldable canopy 100.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments, ±100% in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the appended claims.

That which is claimed:

1. A foldable canopy comprising:

a. a foldable base portion having a first end, a second end opposite the first end, a first side, a second side opposite the first side and substantially parallel therewith, a base floor, and a skirt body, wherein the skirt body is attached at its bottom edge about a periphery of the base floor and comprises an elastic band integrated about its upper periphery;

b. a foldable canopy portion having a first end, a second end opposite the first end, a first side, and a second side opposite the first side; and c. wherein the first end of the foldable canopy portion is attached to the first side of the foldable base portion and the second end of the foldable canopy portion is attached to the second side of the foldable base portion, and wherein the foldable canopy portion is attached to the foldable base portion such that in an unfolded state the foldable canopy portion is substantially arch shaped.

2. The foldable canopy of claim 1, wherein the foldable canopy portion is attached to the foldable base portion such that the arch shape is formed over a portion of the foldable base portion proximate the first end.

3. The foldable canopy of claim 1, further comprising a netting material attached to a portion of either or both of the first side and second side of the foldable canopy portion.

4. The foldable canopy of claim 3, further comprising one or more pockets disposed along a portion of either or both of the first side and second side of the foldable canopy portion, and wherein the pockets are configured to store the netting material therein when not in use.

5. The foldable canopy of claim 4, wherein the one or more pockets comprise a re-closeable closure mechanism.

6. The foldable canopy of claim 3, wherein the netting material comprises a vertical re-closeable opening.

7. The foldable canopy of claim 3, wherein the netting material comprises an elastic band integrated about a periphery of an end portion of the netting material opposite that of an end portion that attaches to the foldable arch portion.

8. The foldable canopy of claim 7, wherein the elastic band is configured to retain the end portion of the netting material in place about an outer portion of a juvenile lounger.

9. The foldable canopy of claim 1, wherein the foldable canopy portion further comprising a foldable visor foldably attached to the first side of the foldable canopy portion.

10. The foldable canopy of claim 9, wherein the foldable visor is foldable between a deployed position and a retracted position, wherein in the deployed position the foldable visor extends out from a side most edge of the first side of the foldable canopy portion.

11. The foldable canopy of claim 10, wherein in the retracted position the foldable visor folds underneath an underside of the foldable canopy portion.

12. The foldable canopy of claim 9, wherein the foldable visor is positioned at about a midpoint along a side most edge of the first side of the foldable canopy portion.

13. The foldable canopy of claim 1, wherein the base floor is configured to accommodate a juvenile lounger thereon, and wherein the elastic band of the skirt body is configured to hold the skirt body in place around a bottom outer portion of the juvenile lounger installed atop the base floor.

14. The foldable canopy of claim 1, wherein the base floor comprises a resilient frame member confined in a substantially ovular shape by a fabric body.

15. The foldable canopy of claim 1, wherein the foldable canopy portion comprises a resilient frame member confined by a fabric body.

16. The foldable canopy of claim 1, wherein the foldable base portion and the foldable canopy portion are configured to be folded into a common generally flat circular state for storage.

17. A method of installing a foldable canopy to a juvenile lounger, the method comprising:

a. providing a foldable canopy in a folded stored state, the foldable canopy comprising:

i. a foldable base portion having a first end, a second end opposite the first end, a first side, a second side opposite the first side and substantially parallel therewith, a base floor, and a skirt body, wherein the skirt body is attached at its bottom edge about a periphery of the base floor and comprises an elastic band integrated about its upper periphery;

ii. a foldable canopy portion having a first end, a second end opposite the first end, a first side, and a second side opposite the first side; and iii. wherein, the first end of the foldable canopy portion is attached to the first side of the foldable base portion and the second end of the foldable canopy portion is attached to the second side of the foldable base portion, and wherein the foldable canopy portion is attached to the foldable base portion such that in an unfolded state the foldable canopy portion is substantially arch shaped;

b. removing the foldable canopy from a storage bag, wherein the foldable canopy is configured to automatically unfolded upon removal from the storage bag; and c. inserting a juvenile lounger atop the foldable base portion.

18. The method of claim 17, further comprising positioning the skirt body about a lower outer perimeter of the juvenile lounger, wherein the elastic band of the skirt body is configured to hold the positioned skirt body in place.

19. The method of claim 17, further comprising extending a netting material attached to the foldable canopy portion and positioning a bottom portion of the netting material about an outer portion of the juvenile lounger, wherein an elastic band integrated about the periphery of the bottom portion of the netting material is configured to hold the positioned netting material in place.

20. A method of storing a foldable canopy, the method comprising:

a. removing the foldable canopy from a juvenile lounger, the foldable canopy comprising:

i. a foldable base portion having a first end, a second end opposite the first end, a first side, and a second side opposite the first side and substantially parallel therewith;

ii. a foldable canopy portion having a first end, a second end opposite the first end, a first side, and a second side opposite the first side; and iii. wherein, the first end of the foldable canopy portion is attached to the first side of the foldable base portion and the second end of the foldable canopy portion is attached to the second side of the foldable base portion, and wherein the foldable canopy portion is attached to the foldable base portion such that in an unfolded state the foldable canopy portion is substantially arch shaped;

b. folding the foldable canopy into a generally flat circular state; and c. inserting the folded foldable canopy into a storage bag configured to receive the folded foldable canopy.

* * * * *